US009739085B2

(12) United States Patent
Kuster et al.

(10) Patent No.: US 9,739,085 B2
(45) Date of Patent: Aug. 22, 2017

(54) SPACER FOR TRIPLE-INSULATED GLAZING UNITS

(71) Applicant: SAINT-GOBAIN GLASS FRANCE, Courbevoie (FR)

(72) Inventors: Hans-Werner Kuster, Aachen (DE); Marc Maurer, Saint Jean aux Bois (FR); Walter Schreiber, Aachen (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 14/781,534

(22) PCT Filed: Mar. 11, 2014

(86) PCT No.: PCT/EP2014/054710
§ 371 (c)(1),
(2) Date: Jan. 22, 2016

(87) PCT Pub. No.: WO2014/198431
PCT Pub. Date: Dec. 18, 2014

(65) Prior Publication Data

US 2016/0138326 A1 May 19, 2016

(30) Foreign Application Priority Data

Jun. 14, 2013 (EP) ..... 13172002

(51) Int. Cl.
*E06B 3/54* (2006.01)
*E06B 3/663* (2006.01)
(Continued)

(52) U.S. Cl.
CPC ..... *E06B 3/66304* (2013.01); *E06B 3/5454* (2013.01); *E06B 3/66319* (2013.01);
(Continued)

(58) Field of Classification Search
CPC ..... E06B 3/66366; E06B 3/5454; E06B 2003/66395
(Continued)

(56) References Cited

U.S. PATENT DOCUMENTS 4,459,789 A * 7/1984 Ford ..... E06B 3/24 52/171.3
5,531,047 A * 7/1996 Leopold ..... B29C 47/30 52/172
(Continued)

FOREIGN PATENT DOCUMENTS

DE 19927683 1/2001
DE 102009006062 7/2010
(Continued)

OTHER PUBLICATIONS

PCT International Search Report mailed on Apr. 4, 2014 for PCT/EP2014/054710 filed on Mar. 11, 2014 in the name of Saint-Gobain Glass France.

*Primary Examiner* — Rodney Mintz
*Assistant Examiner* — Daniel Kenny
(74) *Attorney, Agent, or Firm* — Steinfl + Bruno LLP

(57) ABSTRACT

A spacer for insulated glazing units having at least one polymeric main body with a wall thickness d having a first pane contact surface and a second pane contact surface running parallel thereto, one first glazing interior surface, one second glazing interior surface, one outer surface, one first hollow chamber, and one second hollow chamber. A groove for receiving a pane runs parallel to the first pane contact surface and the second pane contact surface between the first glazing interior surface and the second glazing interior surface. The first hollow chamber adjoins the first glazing interior surface and the second hollow chamber adjoins the second glazing interior surface. The lateral flanks of the groove are formed by the walls of the first hollow
(Continued)

chamber and the second hollow chamber, and the wall thickness d' in the region of the lateral flanks is less than the wall thickness d of the polymeric main body.

26 Claims, 2 Drawing Sheets

(51) Int. Cl.
*E06B 3/67* (2006.01)
*E06B 3/673* (2006.01)
*E06B 3/677* (2006.01)

(52) U.S. Cl.
CPC ..... *E06B 3/66366* (2013.01); *E06B 3/67* (2013.01); *E06B 3/6775* (2013.01); *E06B 3/67326* (2013.01); *E06B 2003/6638* (2013.01)

(58) Field of Classification Search
USPC ..... 52/786.13, 204.593, 204.595
See application file for complete search history.

(56) References Cited

U.S. PATENT DOCUMENTS 6,115,989 A * 9/2000 Boone ..... E06B 3/66366 52/204.61
6,295,788 B2 10/2001 Reichert
7,743,584 B2 * 6/2010 Reichert ..... E06B 3/66323 428/34
8,701,363 B2 * 4/2014 Schield ..... B32B 17/10045 428/331
8,752,354 B2 * 6/2014 Honey ..... E06B 3/5878 52/656.5
9,260,907 B2 * 2/2016 Nieminen ..... E06B 3/66366
2004/0079047 A1 * 4/2004 Peterson ..... E06B 3/66314 52/786.13
2007/0251180 A1 11/2007 Gosling et al.
2010/0000604 A1 * 1/2010 Moineau ..... B60J 1/007 136/259
2012/0141699 A1 * 6/2012 Mader ..... E06B 3/66366 428/34
2014/0109499 A1 4/2014 Nieminen et al.

FOREIGN PATENT DOCUMENTS

DE 102009057156 6/2011
DE 102009057156 A1 * 6/2011
EP 0852280 7/1998
EP 0912455 5/1999
EP 1917222 5/2008
EP 1218307 7/2008
EP 2584135 4/2013
EP 2829681 A1 1/2015
FR 2799005 3/2001
WO 97/48649 12/1997
WO 2007/042688 4/2007
WO 2007101964 9/2007
WO 2010115456 10/2010
WO 2012095266 7/2012

* cited by examiner

SPACER FOR TRIPLE-INSULATED GLAZING UNITS

CROSS REFERENCE TO RELATED APPLICATIONS

The present application is the US national stage of International Patent Application PCT/EP2014/054710 filed internationally on Mar. 11, 2014 which, in turn, claims priority to European Patent Application No. 13172002.1 filed on Jun. 14, 2013.

FIELD OF THE INVENTION

The invention relates to a spacer for triple-insulated glazing units, a triple-insulated glazing unit, a method for their production, and their use.

BACKGROUND

The thermal conductivity of glass is lower by roughly a factor of 2 to 3 than that of concrete or similar building materials. However, since, in most cases, panes are designed significantly thinner than comparable elements made of brick or concrete, buildings frequently lose the greatest share of heat via external glazing. This effect is particularly significant in high-rise buildings with partial or complete glass façades. The increased costs necessary for heating and air-conditioning systems make up a part of the maintenance costs of the building that must not be underestimated. Moreover, as a consequence of more stringent construction regulations, lower carbon dioxide emissions are required. An important approach to a solution for this involves triple-insulated glazing units, without which, primarily as a result of increasingly rapidly rising prices of raw materials and more stringent environmental protection constraints, it is no longer possible to imagine the building construction sector. Consequently, triple-insulated glazing units constitute an increasingly greater share of outward-directed glazing units.

Triple-insulated glazing units generally include three panes made of glass or polymeric materials that are separated from each other by two individual spacers. Another pane is placed on a double-glazing unit using an additional spacer. Very low tolerances apply during the assembly of such a triple glazing unit since the two spacers must be mounted at exactly the same height. Thus, the assembly of triple glazing units is substantially more complex compared to double glazing units because either additional system components must be provided for the assembly of another pane or a time-consuming multiple run through a conventional system is necessary.

The thermal insulation capacity of triple-insulated glass is, compared to single or double glazings, clearly higher. With special coatings, such as low-E coatings, this can be further increased and improved. So-called low-E coatings offer an effective capability of screening out infrared radiation already before entry into the living space and, at the same time, of letting daylight pass through. Low-E coatings are thermal radiation reflecting coatings that reflect a significant portion of the infrared radiation, which, in the summer, results in reduced warming of the living space. Extremely varied low-E coatings are, for example, known from DE 10 2009 006 062 A1, WO 2007/101964 A1, EP 0 912 455 B1, DE 199 27 683 C1, EP 1 218 307 B1, and EP 1 917 222 B1. Such low-E coatings cannot be applied to the center pane of a triple-glazing according to the prior art since the coating causes heating of the pane under sunlight that results in a failure of the adhesive bond between the center pane and the spacers. Moreover, adhesive bonding of the center pane to a functional coating generates additional stresses. To compensate the stresses, the center pane according to the prior art must be prestressed.

DESCRIPTION OF RELATED ART

EP 0 852 280 A1 discloses a spacer for double-insulated glazing units. The spacer includes a metal foil on the bonding surface and glass fiber content in the plastic of the main body. Such spacers are frequently also used in triple-insulated glazing units, wherein a first spacer is mounted between a first outer pane and the inner pane and a second spacer between a second outer pane and the inner pane. The two spacers must be mounted congruently to ensure a visually appealing appearance.

Known from WO 2012 095 266 A1 is a triple-insulated glazing unit with a segment for receiving cables or lighting means. The first pane and the second pane of the insulated glazing unit are connected, via a spacer, to a third pane arranged in the interspace of these two panes, the third pane being connected to the first pane via another spacer.

EP 2 584 135 A2 describes a triple-insulated glazing unit comprising a first and a second glass pane, which are separated by a spacer, with a plastic pane arranged between these two panes. The plastic pane is held between the outer glass panes by additional spacers. The spacers of the plastic pane are preferably made from the same material as the plastic pane itself. Since the spacers of the plastic pane are not connected to the spacer between the first and second pane, all three spacers must be positioned independently of each other.

The spacer systems known from WO 2012 095 266 A1 and EP 2 584 135 A2 are also complex in assembly and require very tolerance-precise assembly of the individual components.

US 2007/0251180 A1 discloses a wall structure whose panes are fixed via a groove.

WO 2010/115456 A1 discloses a hollow profile spacer with multiple hollow chambers for multiple glass panes comprising two outer panes and one or more center panes which are mounted in a groove-shaped receiving profile. The hollow chambers of the spacer are connected to each other via perforations sind such that replacement of desiccant and pressure equalization can take place between the chambers. The spacer can be made either of polymeric materials or of rigid materials, such as stainless steel or aluminum.

DE 10 2009 057 156 A1 describes a triple-insulated glazing unit that includes a shear-resistant spacer that is bonded to the two outer panes in a shear-resistant manner using a high tensile adhesive. The spacer has a groove into which the center pane of the triple glazing is inserted. Flexible mounting of the center pane is done exclusively via a butyl gasket situated in the groove.

SUMMARY

The object of the present invention is to provide a spacer for triple glazing units that enables simplified assembly of the insulated glazing unit and improved stress-free fixing of the center pane as well as to provide an economical method for the assembly of a triple glazing unit with a spacer according to the invention.

The object of the present invention is accomplished according to the invention by a spacer for insulated glazing units, an insulated glazing unit, a method for their assembly and their use according to the independent claims 1, 8, 12, and 15. Preferred embodiments of the invention emerge from the subclaims.

The spacer according to the invention for insulated glazings comprises at least one polymeric main body with a wall thickness d, which has a first pane contact surface and a second pane contact surface running parallel thereto, one first glazing interior surface, one second glazing interior surface, and one outer surface. A first hollow chamber and a second hollow chamber as well as a groove are introduced into the polymeric main body. The groove runs parallel to the first pane contact surface and the second pane contact surface and serves to receive a pane. The first hollow chamber adjoins the first glazing interior surface, whereas the second hollow chamber adjoins the second glazing interior surface, with the glazing interior surfaces situated above the hollow chambers and the outer surface situated below the hollow chambers. "Above" in this context is defined as facing the pane interior space of an insulated glazing with a spacer according to the invention, and "below" is defined as facing away from the pane interior space. Since the groove runs between the first glazing interior surface and second glazing interior surface, it delimits them laterally and separates the first hollow chamber and the second hollow chamber from each other. The lateral flanks of the groove are formed by the walls of the first hollow chamber and the second hollow chamber. The groove forms a recess, which is suitable to receive the center pane (third pane) of an Insulated glazing unit. Thus, the position of the third pane is fixed via two lateral flanks of the groove as well as the bottom surface of the groove. The wall thickness d' in the region of the lateral flanks is less than the wall thickness d of the polymeric main body. When d' is selected less than d, the flexibility of the lateral flanks can be increased such that these compensate thermal expansion of the third pane and, thus, stress-free fixing is ensured at all times.

Thus, the invention makes available a one-piece double spacer, on which all three panes of a triple glazing unit can be fixed. The two outer panes (first pane and second pane) are abutted against the pane contact surfaces, whereas the center pane (third pane) is inserted into the groove. Since the polymeric main body is formed as a hollow profile, the lateral flanks of the hollow chambers are flexible enough to slacken with the insertion of the pane into the groove, on the one hand, and to fix the pane without stress, on the other. The spacer according to the invention thus enables a simplified yet precisely fitting assembly of the triple glazing unit. With the use of the double spacer according to the invention, the slipping out of place of two individual spacers, as are used in the prior art, is impossible. Thus, the time-consuming adjustment of individual spacers to ensure their congruent assembly, as is unavoidable with the prior art, is eliminated. Since the spacer according to the invention has only two pane contact surfaces, the gas loss rate of the insulated glazing compared to a glazing unit with two individual spacers according to the prior art is reduced by 50%. Moreover, failure rates due to entry of water via the pane contact surfaces can also be reduced. Furthermore, the fixing according to the invention of the third pane is done by means of a groove with flexible lateral flanks and not by adhesive bonding. Thus, the spacer according to the invention enables the production of a triple glazing unit with a low-E coating on the third pane, without prestressing of the third pane being necessary. With adhesive bonding or other rigid retention of the pane, the heating up of the pane caused by the low-E coating would promote failure of the adhesive bonding. Moreover, prestressing of the third pane would be necessary to compensate stresses occurring. However, with the use of the spacer according to the invention, the prestressing process is eliminated, by which means a further cost reduction can be achieved. As a result of the stress-free fixing in a groove according to the invention, the thickness and, thus, the weight of the third pane can be advantageously reduced.

Preferably, the bottom surface of the groove directly adjoins the outer surface of the polymeric main body, without either one or both hollow chambers extending below the groove. Thus, the greatest possible depth of the groove is obtained, by which means the area of the lateral flanks for stabilization of the pane is maximized.

The hollow chambers of the spacer according to the invention contribute not only to the flexibility of the lateral flanks, but, furthermore, result in a weight reduction compared to a solidly formed spacer and can be available to receive additional components, such as, for example, a desiccant.

The first pane contact surface and the second pane contact surface constitute the sides of the spacer, against which, during installation of the spacer, the assembly of the outer panes (first pane and second pane) of an insulated glazing unit is done. The first pane contact surface and the second pane contact surface run parallel to each other.

The glazing interior surfaces are defined as the surfaces of the polymeric main body, which are turned in the direction of the interior space of the glazing unit, after installation of the spacer in an insulated glazing unit. The first glazing interior surface lies between the first and the third pane, while the second glazing interior surface is arranged between the third and the second pane.

The outer surface of the polymeric main body is the side opposite the glazing interior surfaces, which is turned away from the interior space of the insulated glazing in the direction of an external insulating layer. The outer surface runs preferably perpendicular to the pane contact surfaces. The sections of the outer surface nearest the pane contact surfaces can, however, alternatively, be inclined at an angle of preferably 30° to 60° relative to outer surface in the direction of the pane contact surfaces. This angled geometry improves the stability of the polymeric main body and enables better bonding of the spacer according to the invention to an insulating foil. A planar outer surface that remains perpendicular to the pane contact surfaces over its total course has, in contrast, the advantage that the sealing surface between the spacer and the pane contact surfaces is maximized and a simpler shape facilitates the production process.

The groove corresponds in its width at least to the thickness of the pane to be inserted.

Preferably the groove is wider than the pane mounted therein such that, additionally, an insert, which prevents slipping of the pane and the development of noise resulting therefrom during opening and closing of the window, can be inserted into the groove. Moreover, the insert compensates the thermal expansion of the third pane during heating such that, independently of climatic conditions, stress-free fixing is ensured. Also, the use of an insert is advantageous with regard to minimizing the diversity of variants of the spacer. To keep the diversity of variants as small as possible and, nevertheless, to enable a variable thickness of the center pane, a spacer can be used with different inserts. Variation of the insert is substantially more economical with regard to production costs than variation of the spacer.

In another preferred embodiment, the spacer according to the invention is assembled in the groove without an insert.

Since the wall thickness d' of the lateral flanks is reduced in comparison to the wall thickness d of the polymeric main body, there is, as a result, already increased flexibility of the lateral flanks. If d' is selected less than d, the flexibility of the lateral flanks can be increased such that they compensate thermal expansion of the third pane even without the use of an insert and, thus, stress-free fixing is always ensured. It has been demonstrated that a wall thickness of the lateral flanks of d'<0.85 d, preferably of d'<0.7 d, particularly preferably of d'<0.5 d, is particularly suitable for that. If no insert is fitted into the groove, the first interpane space and the second interpane space are not airtightly sealed from each other. This has the advantage that air circulation can be generated, particularly when a pressure compensation system is integrated into the spacer.

In another preferred embodiment, the embodiments described are combined, with both an insert used and the wall thickness of the lateral flanks also reduced. As a result, compensation of the thermal expansion of the third pane is done both by means of the flexibility of the lateral flanks and also by means of the insert. At the same time, the possibility remains of varying the thickness of the third pane to a certain extent and to compensate for this through the selection of the insert. In an advantageous embodiment, the insert is formed directly on the polymeric main body and thus implemented in one piece therewith, with the polymeric main body and the insert coextruded. Alternatively, it would also be conceivable to form the insert directly on the polymeric main body, for example, by manufacturing the two components together in a two-component injection molding process.

The lateral flanks of the groove can either run parallel to the pane contact surfaces or even be inclined in one direction or another. By means of an inclination of the lateral flanks in the direction of the third pane, a taper is created that can serve to selectively fix the third pane. Furthermore, curved lateral flanks are also conceivable, with only the center section of the lateral flanks contacting the third pane. Such a curvature of the lateral flanks is particularly advantageous in conjunction with a reduced wall thickness d' of the lateral flanks. The curved lateral flanks have a very good spring action, in particular with low wall thicknesses. As a result, the flexibility of the lateral flanks is further increased such that thermal expansion of the third pane can be particularly advantageously compensated. In a preferred embodiment, the curved lateral flanks of the pane are made from a material different from the polymeric main body and coextruded therewith. This is particularly advantageous as, thus, the flexibility of the lateral flanks can be selectively increased through the choice of a suitable material, while the stiffness of the polymeric main body is retained.

The polymeric main body preferably has, along the glazing interior surfaces, a total width from 10 mm to 50 mm, particularly preferably from 20 mm to 36 mm. Through the selection of the width of the glazing interior surfaces, the distance between the first and the third pane and between the third and the second pane, respectively, is determined. Preferably, the widths of the first glazing interior surface and the second glazing interior surface are equal. Alternatively, asymmetric spacers are also possible, wherein the two glazing interior surfaces have different widths. The precise dimension of the glazing interior surfaces is guided by the dimensions of the insulated glazing and the interpane space sizes desired.

The polymeric main body preferably has, along the pane contact surfaces, a height from 5 mm to 15 mm, particularly preferably from 5 mm to 10 mm.

The groove preferably has a depth from 1 mm to 15 mm, particularly preferably from 2 mm to 4 mm. Thus, stable fixing of the third pane can be achieved.

The wall thickness d of the polymeric main body is 0.5 mm to 15 mm, preferably 0.5 mm to 10 mm, particularly preferably 0.7 mm to 1 mm.

The spacer preferably includes an insulating foil on the outer surface of the polymeric main body. The insulating foil includes at least one polymeric layer as well as a metallic layer or a ceramic layer. The layer thickness of the polymeric layer is between 5 μm and 80 μm, while metallic layers and/or ceramic layers with a thickness from 10 nm to 200 nm are used. Within the layer thicknesses mentioned, particularly good leakproofness of the insulating foil is achieved.

Particularly preferably, the insulating foil contains at least two metallic layers and/or ceramic layers, which are alternatingly arranged with at least one polymeric layer. Preferably, the outer layers are formed by the polymeric layer. The alternating layers of the insulating foil can be bonded and applied to each other using extremely varied methods known in the prior art. Methods for deposition of metallic or ceramic layers are well known to the person skilled in the art. The use of an insulating foil with an alternating layer sequence is particularly advantageous with regard to the leakproofness of the system. A defect in one of the layers does not result in a functional loss of the insulating foil. By comparison, in the case of a single layer, even a small defect can result in a complete failure. Furthermore, the application of multiple thin layers is advantageous in comparison with one thick layer since the risk of internal adhesion problems rises with increasing layer thickness. Also, thicker layers have higher conductivity such that such a foil is less suitable thermodynamically.

The polymeric layer preferably includes polyethylene terephthalate, ethylene vinyl alcohol, polyvinylidene chloride, polyamides, polyethylene, polypropylene, silicones, acrylonitriles, polyacrylates, polymethyl acrylate, and/or copolymers or mixtures thereof. The metallic layer preferably includes iron, aluminum, silver, copper, gold, chromium, and/or alloys or mixtures thereof. The ceramic layer preferably contains silicon oxides and/or silicon nitrides.

The insulating foil preferably has gas permeation of less than 0.001 g/($m^2$ h).

The composite made of a main body and insulating foil preferably has a PSI value less than (equal to) 0.05 W/mK, particularly preferably less than (equal to) 0.035 W/mK. The insulating foil can be applied on the polymeric main body, for example, glued. Alternatively, the insulating foil can be coextruded together with the main body.

The polymeric main body preferably contains a desiccant, preferably silica gels, molecular sieves, $CaCl_2$, $Na_2SO_4$, activated carbon, silicates, bentonites, zeolites, and/or mixtures thereof. The desiccant is preferably incorporated into the main body. Particularly preferably, the desiccant is situated in the first and second hollow chamber of the main body.

In a preferred embodiment, the first glazing interior surface and/or the second glazing interior surface have at least one opening. Preferably, a plurality of openings are made in both glazing interior surfaces. The total number of openings depends on the size of the insulated glazing unit. The openings connect the hollow chambers to the interpane spaces; as a result, a gas exchange therebetween becomes possible. This permits absorption of atmospheric moisture by a desiccant situated in the hollow chambers and, thus, fogging of the panes is prevented. The openings are preferably implemented as slots, particularly preferably as slots with a width of 0.2 mm and a length of 2 mm. The slots ensure optimum air exchange without the desiccant being able to penetrate from the hollow chambers into the interpane spaces.

The polymeric main body preferably contains polyethylene (PE), polycarbonates (PC), polypropylene (PP), polystyrene, polybutadiene, polynitriles, polyesters, polyurethanes, polymethyl methacrylates, polyacrylates, polyamides, polyethylene terephthalate (PET), polybutylene terephthalate (PBT), preferably acrylonitrile butadiene styrene (ABS), acrylonitrile styrene acrylester (ASA), acrylonitrile butadiene styrene/polycarbonate (ABS/PC), styrene acrylonitrile (SAN), PET/PC, PBT/PC, and/or copolymers or mixtures thereof.

Preferably, the polymeric main body is glass-fiber-reinforced. Through the selection of the glass fiber content in the main body, the coefficient of thermal expansion of the main body can be varied and adapted. Through the adaptation of the coefficient of thermal expansion of the polymeric main body and of the insulating foil, temperature-induced stresses between the different materials and flaking of the insulating foil can be avoided. The main body preferably has a glass fiber content from 20% to 50%, particularly preferably from 30% to 40%. The glass fiber content in the polymeric main body improves strength and stability at the same time.

The invention further includes an insulated glazing unit with at least one first pane, one second pane, and one third pane and a peripheral spacer according to the invention surrounding the panes. The first pane contacts the first pane contact surface of the spacer, while the second pane contacts the second pane contact surface. The third pane is inserted into the groove of the spacer.

At the corners of the insulated glazing unit, the spacers are linked to each other preferably by corner connectors. Such corner connectors can be implemented, for example, as a molded plastic part with a gasket, in which two spacers provided with a miter cut abut. In principle, extremely varied geometries of the insulated glazing unit are possible, for example, rectangular, trapezoidal, and rounded shapes. To produce round geometries, the spacer according to the invention can, for example, be bent in the heated state.

The panes of the insulated glazing are connected to the spacer via a gasket. For this purpose, a gasket is installed between the first pane and the first pane contact surface and/or the second pane and the second pane contact surface. The gasket preferably includes a polymer or a silane-modified polymer, particularly preferably organic polysulfides, silicones, room temperature vulcanizing silicone rubber, high temperature vulcanizing silicone rubber, peroxide vulcanizing silicone rubber, and/or addition vulcanizing silicone rubber, polyurethanes, butyl rubber, and/or polyacrylates.

An external insulation is filled into the edge region between the outer surface of the spacer according to the invention and the outer edges of the panes. A plastic sealing compound, for example, is used as external insulation. The external insulation preferably includes polymers or silane-modified polymers, particularly preferably organic polysulfides, silicones, room temperature vulcanizing (RTV) silicone rubber, high temperature vulcanizing (HTV) silicone rubber, peroxide vulcanizing silicone rubber, and/or addition vulcanizing silicone rubber, polyurethanes, butyl rubber, and/or polyacrylates.

The first pane, the second pane, and/or the third pane of the insulated glazing unit preferably contain glass and/or polymers, particularly preferably quartz glass, borosilicate glass, soda lime glass, polymethyl methacrylate, and/or mixtures thereof.

The first pane and the second pane have a thickness from 2 mm to 50 mm, preferably 3 mm to 16 mm, with the two panes possibly also having different thicknesses. The third pane has a thickness from 1 mm to 4 mm, preferably from 1 mm to 3 mm, and particularly preferably from 1.5 mm to 3 mm. The spacer according to the invention enables, through stress-free fixing, an advantageous reduction in the thickness of the third pane while retaining the same stability of the glazing unit. Preferably, the thickness of the third pane is less than the thicknesses of the first and second pane. In a possible embodiment, the thickness of the first pane is 3 mm, the thickness of the second pane the second pane is 4 mm, and the thickness of the third pane is pane 2 mm. Such an asymmetric combination of pane thicknesses yields a significant improvement of the acoustic damping.

The insulated glazing unit is filled with a protective gas, preferably with an inert gas, preferably argon or krypton, which reduce the heat transfer value in the insulated glazing interspace.

The third pane of the insulated glazing unit preferably has a low-E coating.

The third pane of the insulated glazing unit is preferably not prestressed.

In another embodiment, the insulated glazing unit includes more than three panes. In this case, the spacer can contain multiple grooves that can receive additional panes. Alternatively, several panes could be implemented as a composite glass pane.

The invention further includes a method for producing an insulated glazing unit according to the invention comprising the steps:

a) insertion of the third pane into the groove of the spacer, b) abutting the first pane against the first pane contact surface of the spacer, c) abutting the second pane against the second pane contact surface of the spacer, and d) pressing the pane arrangement together.

After insertion of the third pane into the groove of the spacer, this preassembled component can be processed in a conventional double glazing system known to the person skilled in the art. The costly installation of additional system components or loss of time during multiple runs of a system can thus be avoided. This is particularly advantageous with regard to a productivity gain and cost reduction. According to the prior art, multiple spacers or multiple individual components of one spacer are required for the assembly of a triple glazing unit. The precisely fitting adjustment of these components is time-consuming and cannot be done on a conventional double glazing system. Moreover, even with the use of low-E or other functional coatings on the third pane, according to the method of the invention, no prestressing of the third pane is necessary, since the spacer according to the invention fixes the pane stress-free in its periphery. By means of the spacer according to the invention, the production of a triple glazing unit is thus significantly simplified.

In a preferred embodiment of the method, first, the spacer is preformed into a rectangle open on one side. For example, three spacers can be provided with a miter cut and linked at the corners by corner connectors. Instead, the spacers can also be welded directly to each other, for example, by ultrasonic welding. Into the U-shaped spacer, starting from the open side of the arrangement, the third pane is pushed into the groove of the spacer. The remaining open edge of the third pane is then likewise closed with a spacer. Optionally, an insert can be applied on the edge of the pane before the assembly of the spacer. Thereafter, the processing of the preassembled component is done according to the method according to the invention, wherein, in the next step, the first pane is brought into contact with the first pane contact surface.

Preferably, the interpane spaces between the first pane and the third pane as well as between the second pane and the third pane are filled with a protective gas before the pressing together of the pane arrangement.

The invention further includes the use of a spacer according to the invention in multipane glazing units, preferably in insulated glazing units, particularly preferably in triple-insulated glazing units.

BRIEF DESCRIPTION OF THE DRAWINGS

In the following, the invention is explained in detail with reference to drawings. The drawings are purely schematic and not true to scale. They in no way restrict the invention. They depict.

DETAILED DESCRIPTION

Figure 1:
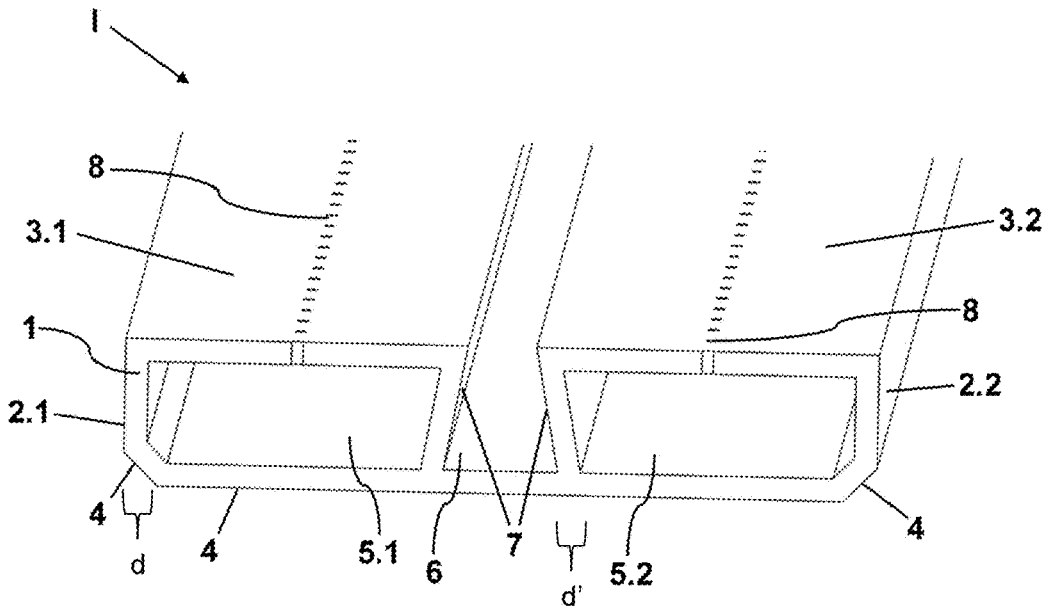
FIG. 1 one possible embodiment of the spacer according to the invention.

FIG. 1 depicts a cross-section of the spacer according to the invention (I). The glass-fiber-reinforced polymeric main body (1) comprises one first pane contact surface (2.1), one second pane contact surface (2.2) running parallel thereto, one first glazing interior surface (3.1), one second glazing interior surface (3.2), and one outer surface (4). Between the outer surface (4) and the first glazing interior surface (3.1) is situated a first hollow chamber (5.1), while a second hollow chamber (5.2) is arranged between the outer surface and the second glazing interior surface (3.2). Between the two hollow chambers (5.1, 5.2) is situated a groove (6), which runs parallel to the pane contact surfaces (2.1, 2.2). The lateral flanks (7) of the groove (6) are formed by the walls of the two hollow chambers (5.1, 5.2), while the bottom surface of the groove (6) directly adjoins the outer surface (4). Thus, a maximum depth of the groove (6) is obtained. The lateral flanks (7) of the groove (6) are inclined inward in the direction of a pane to be received in the groove (6) pane. This creates, at the level of the glazing interior surfaces (3.1, 3.2), a tapering of the groove (6), which favors the fixing of the pane in the groove (6). The wall thickness d of the polymeric main body is 1 mm, while the reduced wall thickness d' in the region of the lateral flanks is 0.8 mm. The outer surface (4) runs largely perpendicular to the pane contact surfaces (2.1, 2.2) and parallel to the glazing interior surfaces (3.1, 3.2). The sections of the outer surface (4) nearest the pane contact surfaces (2.1, 2.2) are, however, inclined at an angle of preferably 30° to 60° relative to the outer surface (4) in the direction of the pane contact surfaces (2.1, 2.2). This angled geometry improves the stability of the polymeric main body (1) and enables better adhesion of the spacer according to the invention (I) to an insulating foil. The polymeric main body (1) contains styrene acrylonitrile (SAN) with roughly 35 wt.-% glass fibers. The glazing interior surfaces (3.1, 3.2) have, at regular intervals, openings (8), which connect the hollow chambers (5.1, 5.2) to the airspace located above the glazing interior surfaces (3.1, 3.2). The spacer (I) has a height of 6.5 mm and a total width of 34 mm. The groove (6) has a depth of 3 mm, while the first glazing interior surface (3.1) is 16 mm wide and the second glazing interior surface (3.2) is 16 mm wide. The total width of the spacer (I) is the sum of the widths of the glazing interior surfaces (3.1, 3.2) and the thickness of the third pane (15) with insert (9) to be inserted into the groove (6).

Figure 2:
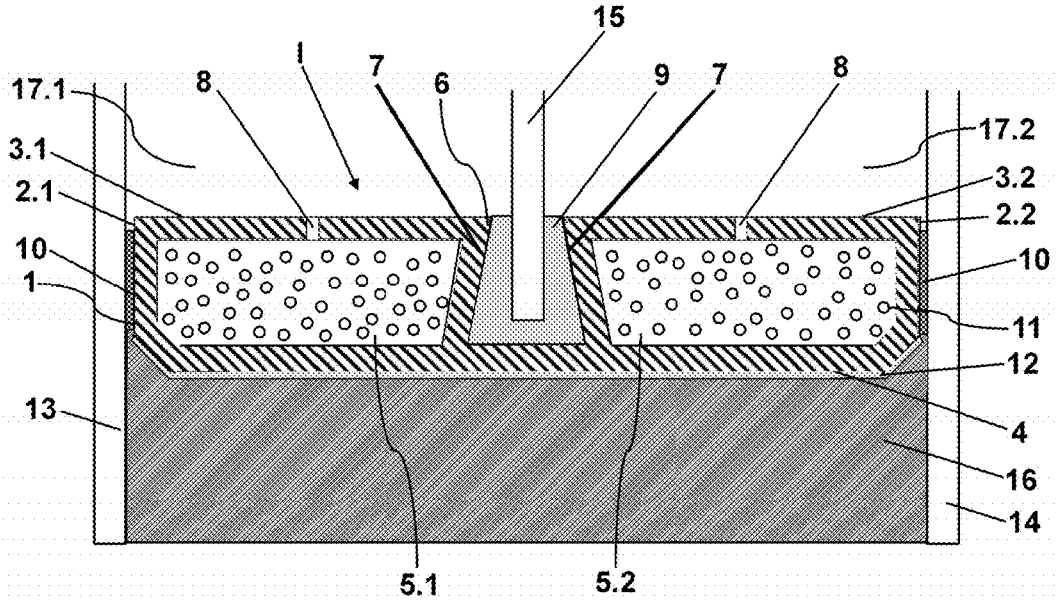
FIG. 2 a cross-section of the insulated glazing unit according to the invention, and FIG. 3 a flowchart of one possible embodiment of the method according to the invention.

FIG. 2 depicts a cross-section of the insulated glazing unit according to the invention with a spacer (I) of FIG. 1. The first pane (13) of the triple-insulated glazing unit is connected to the first pane contact surface (2.1) of the spacer (I) via a gasket (10), while the second pane (14) is connected to the second pane contact surface (2.2) via a gasket (10). The gasket (10) is made of butyl rubber. A third pane (15) is inserted via an insert (9) into the groove (6) of the spacer. The insert (9) surrounds the edge of the third pane (15) and fits flush into the groove (6). The insert (9) is made of ethylene propylene diene rubber. The insert (9) fixes the third pane (15) stress-free and compensates thermal expansion of the pane. Moreover, the insert (9) prevents development of noise due to slipping of the third pane (15). The intermediate space between the first pane (13) and the third pane (15) is defined as the first interpane space (17.1) and the space between the third pane (15) and the second pane (14) is defined as the second interpane space (17.2). The first glazing interior surface (3.1) of the spacer (I) is in the first interpane space (17.1), while the second glazing interior surface (3.2) is arranged in the second interpane space (17.2). Via the openings (8) in the glazing interior surfaces (3.1, 3.2), the interpane spaces (17.1, 17.2) are connected to the respective hollow chamber (5.1, 5.2) lying therebelow. A desiccant (11) made of a molecular sieve is situated in the hollow chambers. Via the openings (8), a gas exchange takes place between the hollow chambers (5.1, 5.2) and the interpane spaces (17.1, 17.2), by means of which the desiccant (11) withdraws the atmospheric moisture from the interpane spaces (17.1, 17.2). On the outer surface (4) of the spacer (I), an insulating foil (12) is applied, which reduces the heat transfer through the polymeric main body (1) into the interpane spaces (17). The insulating foil (12) can, for example, be affixed on the polymeric main body (1) with a polyurethane melt adhesive. The insulating foil (12) comprises four polymeric layers made of polyethylene terephthalate with a thickness of 12 μm and three metallic layers made of aluminum with a thickness of 50 nm. The metallic layers and the polymeric layers are each mounted alternatingly, with the two outer layers being formed by polymeric layers. The first pane (13) and the second pane (14) protrude beyond the spacer (I) such that a circumferential edge region is created, which is filled with an external insulation (16). This external insulation (16) is formed from an organic polysulfide. The first pane (13) and the second pane (14) are made of soda lime glass with a thickness of 3 mm, while the third pane (15) is formed from soda lime glass with a thickness of 2 mm.

Figure 3:
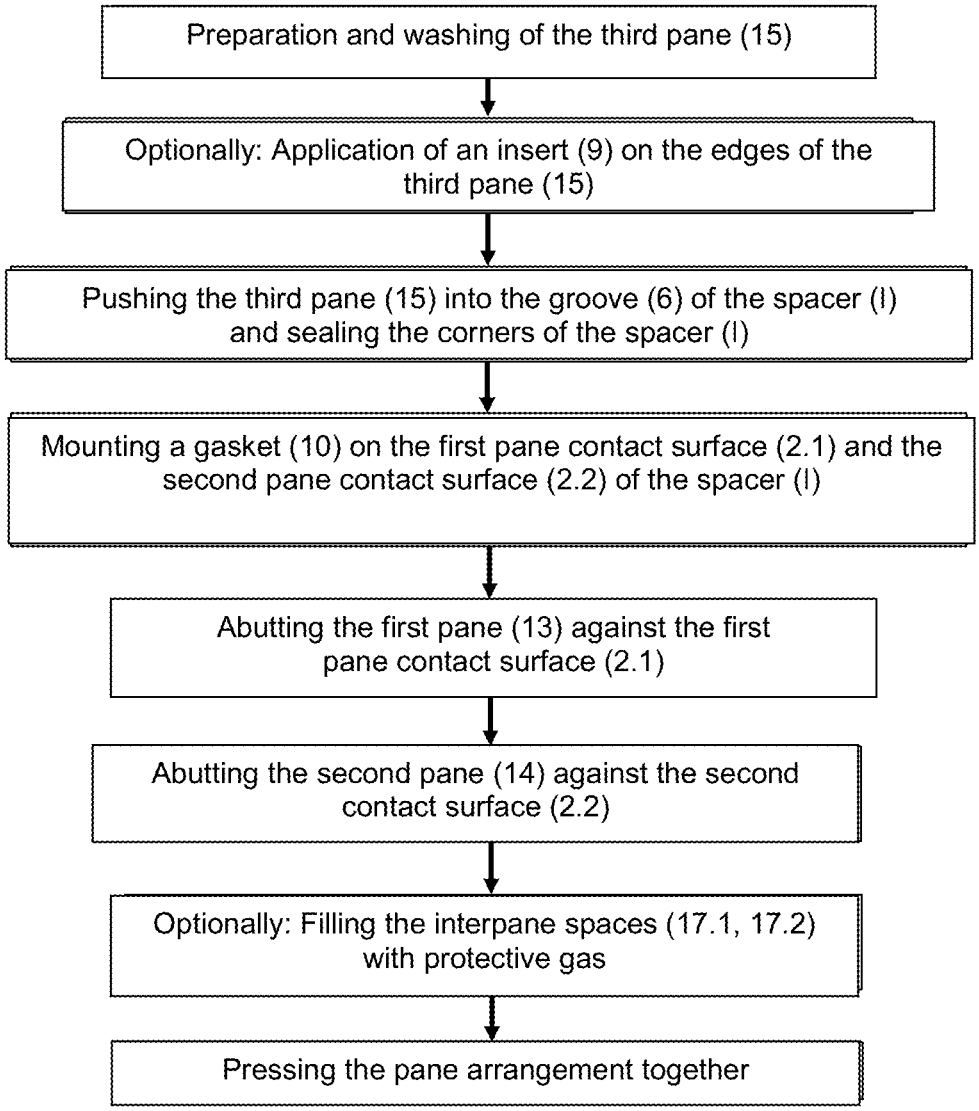

FIG. 3 depicts a flowchart of one possible embodiment of the method according to the invention. First, the third pane (15) is prepared and washed. Optionally, an insert (9) is then applied on the edges of the third pane (15). The third pane (15) is now pushed into the groove (6) of the spacer according to the invention (I). Three spacers (I) can, for example, be preformed into a rectangle open on one side, with the third pane (15) pushed into the groove (6) via the open side. Then, the fourth edge of the panes is closed by a spacer (I). The corners of the spacers are either welded or linked to each other by corner connectors. The first three process steps serve for the preparation of the third pane (15) with a spacer (I) according to the invention. Such a preassembled component can then be further processed in a conventional double glazing system. In the double glazing system, the assembly of the first pane (13) and the second pane (14) against the pane contact surfaces (2.1, 2.2) is done via a gasket (10) in each case. Optionally, a protective gas can be introduced into the interpane spaces (17.1, 17.2). In a last step, the insulated glazing unit is pressed together.

LIST OF REFERENCE CHARACTERS

I spacer
1 polymeric main body
2 pane contact surfaces
2.1 first pane contact surface
2.2 second pane contact surface
3 glazing interior surfaces
3.1 first glazing interior surface
3.2 second glazing interior surface
4 outer surface
5 hollow chambers
5.1 first hollow chamber
5.2 second hollow chamber
6 groove
7 lateral flanks
8 openings
9 insert
10 gasket
11 desiccant
12 insulating foil
13 first pane
14 second pane
15 third pane
16 external insulation
17 interpane spaces
17.1 first interpane space
17.2 second interpane space

The invention claimed is:

1. A spacer for insulated glazing units, the spacer comprising at least one polymeric main body comprising a first pane contact surface and a second pane contact surface running parallel thereto, a first glazing interior surface, a second glazing interior surface, an outer surface, a first hollow chamber, and a second hollow chamber, wherein a groove configured for receiving a pane runs parallel to the first pane contact surface and the second pane contact surface between the first glazing interior surface and the second glazing interior surface, the first hollow chamber adjoins the first glazing interior surface and the second hollow chamber adjoins the second glazing interior surface, lateral flanks of the groove are formed by walls of the first hollow chamber and the second hollow chamber, a wall thickness d' of the lateral flanks is less than 85% of a wall thickness d of all other portions of the polymeric main body; and the lateral flanks of the groove are flexible, such that the groove is configured to affix the pane without adhesive bonding.

2. The spacer for insulated glazing units according to claim 1, wherein the lateral flanks of the groove include an insert.

3. The spacer according to claim 2, wherein the insert comprises an elastomer.

4. The spacer according to claim 3, wherein the elastomer comprises ethylene propylene diene rubber.

5. A method of using the spacer according to claim 1 in multipane glazing units.

6. The method of claim 5, wherein the multipane glazing units are insulated glazing units.

7. The method of claim 6, wherein the insulated glazing units are triple insulated glazing units.

8. The spacer for insulated glazing units according to claim 1, wherein for the wall thickness d' in the region of the lateral flanks d' is <0.7 d.

9. The spacer according to claim 8, wherein d' is <0.5 d.

10. The spacer for insulated glazing units according to claim 1, wherein an insulating foil is applied on the outer surface of the polymeric main body, the insulating foil comprises at least one polymeric layer as well as at least one metallic or ceramic layer which is alternatingly arranged with the at least one polymeric layer.

11. The spacer according to claim 10, wherein the at least one metallic or ceramic layer comprises at least two metallic or ceramic layers.

12. The spacer for insulated glazing units according to claim 1, wherein the polymeric main body contains a desiccant.

13. The spacer according to claim 12, wherein the desiccant is silica gels, molecular sieves, CaCl2, Na2SO4, activated carbon, silicates, bentonites, zeolites, or mixtures thereof.

14. The spacer for insulated glazing units according to claim 1, wherein the first glazing interior surface or the second glazing interior surface has at least one opening that connects the corresponding first or second hollow to an interpane space.

15. The spacer according to claim 14, wherein the at least one opening is a plurality of openings.

16. An insulated glazing unit comprising at least one first pane, one second pane, and one third pane, and one peripheral spacer surrounding the panes, the peripheral spacer being the spacer according to claim 1, wherein the first pane contacts the first pane contact surface, the second pane contacts the second pane contact surface, and the third pane is inserted into the groove of the spacer.

17. The insulated glazing unit according to claim 16, wherein a gasket is mounted between the first pane and the first pane contact surface or the second pane and the second pane contact surface.

18. The insulated glazing unit according to claim 17, wherein the gasket comprises a polymer.

19. The insulated glazing unit according to claim 18, wherein the polymer is a silane-modified polymer.

20. The insulated glazing unit according to claim 17, wherein the gasket comprises organic polysulfides, silicones, room temperature vulcanizing silicone rubber, high temperature vulcanizing silicone rubber, peroxide vulcanizing silicone rubber, addition vulcanizing silicone rubber, polyurethanes, butyl rubber, polyacrylates, or a combination thereof.

21. The insulated glazing unit according to claim 16, wherein the first pane, the second pane, or the third pane contain glass or polymers or a combination of glass and polymers.

22. The insulated glass unit according to claim 21, wherein the glass or polymers or a combination of glass and polymers comprises quartz glass, borosilicate glass, soda lime glass, polymethyl methacrylate, or mixtures thereof.

23. The spacer for insulated glazing units according to claim 1, wherein the polymeric main body contains polyethylene, polycarbonates, polypropylene, polystyrene, polybutadiene, polynitriles, polyesters, polyurethanes, polymethyl methacrylates, polyacrylates, polyamides, polyethylene terephthalate, polybutylene terephthalate, preferably acrylonitrile butadiene styrene, acrylonitrile styrene acrylester, acrylonitrile butadiene styrene/polycarbonate, styrene acrylonitrile, PET/PC, PBT/PC, or copolymers or mixtures thereof.

24. A method for producing an insulated glazing unit comprising at least one first pane, one second pane, and one third pane, and one peripheral spacer surrounding the panes, the peripheral spacer comprising at least one polymeric main body comprising a first pane contact surface and a second pane contact surface running parallel thereto, a first glazing interior surface, a second glazing interior surface, an outer surface, a first hollow chamber, and a second hollow chamber, wherein a groove configured for receiving a pane runs parallel to the first pane contact surface and the second pane contact surface between the first glazing interior surface and the second glazing interior surface, the first hollow chamber adjoins the first glazing interior surface and the second hollow chamber adjoins the second glazing interior surface, lateral flanks of the groove are formed by walls of the first hollow chamber and the second hollow chamber, and a wall thickness d' in the region of the lateral flanks is less than 85% of a wall thickness d of all other portions of the polymeric main body;

wherein the first pane contacts the first pane contact surface, the second pane contacts the second pane contact surface, and the third pane is inserted into the groove of the spacer, wherein at least the third pane is inserted into the groove of the spacer, the first pane is abutted against the first pane contact surface of the spacer, the second pane is abutted against the second pane contact surface of the spacer, and the pane arrangement of the panes and the spacer is pressed together.

25. The method according to claim 24, wherein, first, the spacer is preformed into a rectangle open on one side, the third pane is pushed into the groove of the spacer, and the remaining edge of the pane is closed with a spacer.

26. The method according to claim 24, wherein the interpane spaces between the first pane and the third pane as well as between the second pane and the third pane are filled with a protective gas.

* * * * *